United States Patent [19]

Steenson et al.

[11] 4,105,240

[45] Aug. 8, 1978

[54] LIFTING DEVICE FOR LARGE PANELS

[75] Inventors: Thomas W. Steenson, Richmon Hill; W. Donald Paton, Aurora, both of Canada

[73] Assignee: Butler Manufacturing Company, Kansas City, Mo.

[21] Appl. No.: 819,118

[22] Filed: Jul. 26, 1977

[51] Int. Cl.[2] ..... B66C 1/30

[52] U.S. Cl. ..... 294/81 R; 294/67 BC; 294/116

[58] Field of Search ..... 294/62, 63 R, 67 R, 294/67 B, 67 BB, 67 BC, 81 R, 106, 116, 117

[56] References Cited

U.S. PATENT DOCUMENTS

| | | | |
|---|---|---|---|
| 729,939 | 6/1903 | Jones | 294/116 |
| 1,216,362 | 2/1917 | Richards et al. | 294/81 R |
| 2,564,357 | 8/1951 | Falkner | 294/62 |
| 2,841,434 | 7/1958 | Hooker et al. | 294/67 BC |
| 3,020,078 | 2/1962 | Ray | 294/67 BC X |
| 3,115,361 | 12/1963 | Miles | 294/67 BC X |
| 3,206,534 | 9/1965 | Vogele et al. | 294/63 R X |

FOREIGN PATENT DOCUMENTS

| | | | |
|---|---|---|---|
| 464,265 | 4/1950 | Canada | 294/81 R |
| 586,637 | 7/1974 | Switzerland | 294/81 R |

*Primary Examiner*—Johnny D. Cherry

*Attorney, Agent, or Firm*—Shoemaker and Mattare, Ltd.

[57] ABSTRACT

A device for lifting large concrete panels. The device includes gripping jaws pivotally attached to a main lifting beam to transmit lifting forces to the panel being hoisted in a manner which will not crush or otherwise damage the panel. The device is amenable to adjustment for providing the most expeditious lifting technique.

10 Claims, 5 Drawing Figures

LIFTING DEVICE FOR LARGE PANELS

BACKGROUND OF THE INVENTION

The present invention relates in general to lifting devices, and more particularly, to devices for lifting heavy and bulky panels.

In the fabrication of concrete panels for use in modular buildings, and the like, the panels are often slip-formed on long line casting beds with the exterior panel surfaces textured in a variety of patterns. The panels are sawn to the required length, and finished panels are removed from the casting beds and stockpiled for later delivery and use. At the construction site, panels are hoisted into position by erecting crews using lifting devices.

There are several ways for handling such panels during the fabrication process, including a method utilizing ice tong-like gripping members, such as self-gripping claw grab or grip tongs, or the like. Such ice tong-like devices are suitable for use on panels having widths of 4 feet or less, but are not suitable for wider panels as the pressure applied to the panel by such gripping devices may crush or otherwise damage the panel. Sometimes lifting loops are embedded in the top surface of the panel for handling purposes (common for floor members), but this is unsightly and unacceptable for wall panels.

One device proposed for use with wide panels includes reinforcing hardware embedded in the panel itself. However, such a device produces a very slow operation and requires costly hardware.

The device embodying the teachings of the present invention has pivot points for the panel gripping elements located so that sufficient lifting pressure can be applied to the panel to lift large panels without crushing those panels.

SUMMARY OF THE INVENTION

The device embodying the teachings of the present invention is able to lift 8 foot wide concrete panels without danger of crushing or otherwise damaging those panels.

The device includes a pair of gripping jaws each connected at one end of a main lifting beam which has elements thereon for connection to other hoisting equipment. The gripping jaws are pivotally connected to the main beam and include a supporting device pivotally connected thereto. The supporting device is adapted to assume a repose position wherein that supporting device will not contact a panel to be lifted, and a working position wherein that supporting device will contact a panel to be lifted. Locking means on each of the gripping jaws maintains the supporting device in the repose position, and removable locking pins are used to maintain each supporting device in the working, or supporting, position. A hold-down detent and a ram are also mounted on each gripping jaw to engage a panel to be lifted.

A positioning mechanism is attached to each gripping jaw and to the main lifting beam and includes elements which cause the gripping jaw to move with respect to the main lifting beam when the mechanism is actuated.

The gripping jaw is pivotally connected to the main lifting beam at pivot points that are properly located so that a clamping technique can be used which applies sufficient pressure to the sides of the panels to pick up those panels without crushing or otherwise damaging them.

As a comparison to the aforediscussed ice tong-like gripping devices, it is noted that the pivot points for the gripping jaws of the preferred device embodying the teachings of the present invention are approximately 4 feet-5 inches apart, as opposed to pivot points of the prior art which are about 8 inches apart. The outward movement of the pivot points in the device embodying the teachings of the present invention redirects clamping pressure applied to the panel by the lifting device from a force which is primarily directed along the panel thickness dimension in the prior art to a clamping force which is primarily directed along the panel width dimension in the present invention. Such thickness directed clamping forces place tensile and other forces on the panel which forces are damaging to concrete panels; whereas, the width directed clamping forces generate compressive forces which are resisted well by concrete panels.

Because the supporting devices and gripping jaws themselves in the present invention are adapted to be pivoted into both repose and working positions, positioning of the clamping device as a whole is very easy and expeditious. Proper adjustment of the various elements is easily accomplished to produce the most efficient lifting technique.

OBJECTS OF THE INVENTION

It is, accordingly, a main object of the present invention to lift wide concrete panels.

It is another object of the present invention to lift wide concrete panels without crushing or otherwise damaging the same.

It is a further object of the present invention to provide a device which is amenable to adjustment for adjusting lifting techniques.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
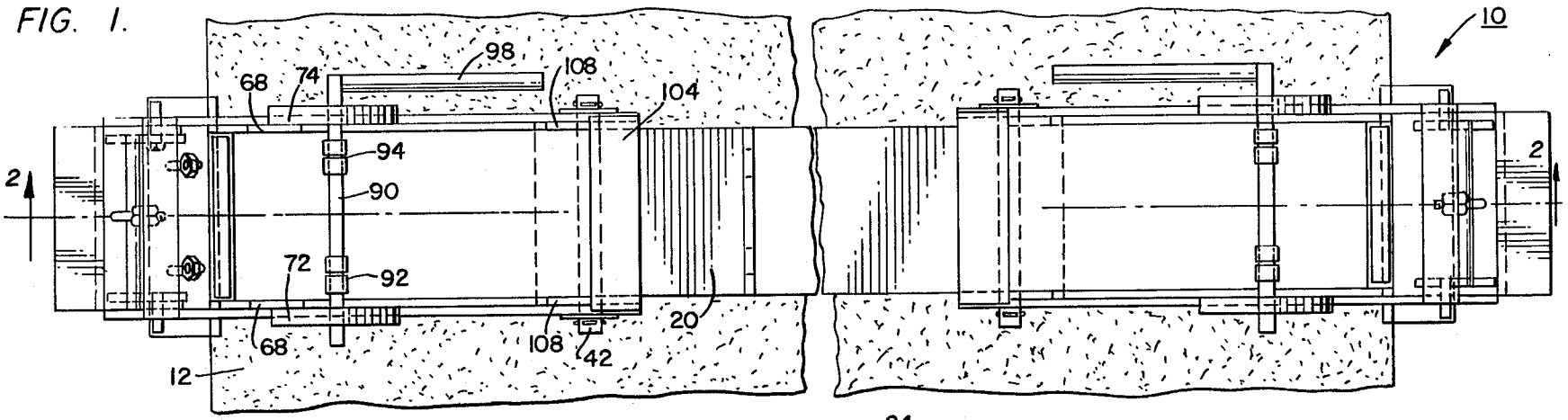
FIG. 1 is a top plan view of the device embodying the teachings of the present invention.
Figure 2:
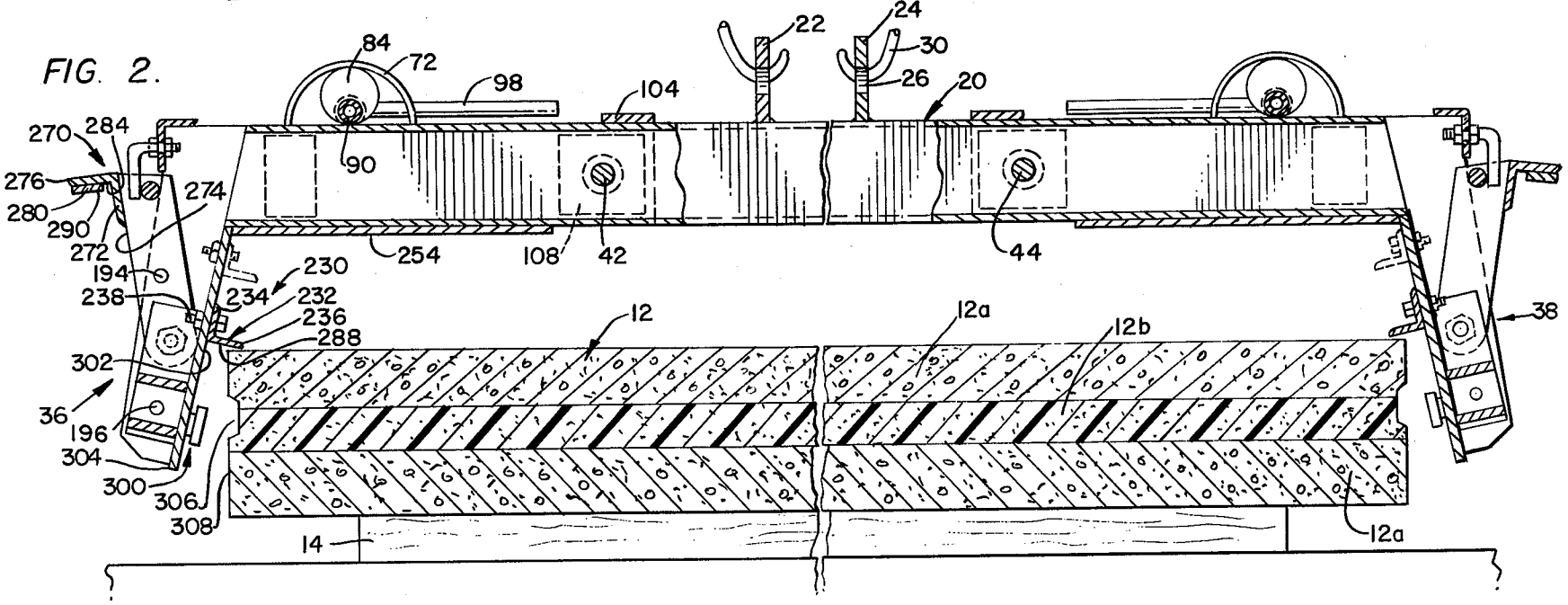
FIG. 2 is an elevation view taken along line 2—2 of FIG. 1 showing the device embodying the teachings of the present invention in the repose configuration.

Shown in FIGS. 1 and 2 is an adjustable beam type grip holder 10 for lifting large concrete panels, such as insulated panel 12 having a sandwich-type construction which includes outer layers **12*a* and inner layer 12*b*, from a wood blocking pallet 14**, or from a continuous steel pallet on which the product has been extruded. As shown in FIGS. 1 and 2, the holder 10 comprises an elongate main lifting beam 20 having a pair of lifting brackets 22 and 24 surmounted thereon. The brackets each have a plurality of eyelets 26 defined therein to receive lifting hooks, such as hook 30, to which is attached a lifting mechanism (not shown), such as a crane, or a trolley, or the like. The main beam is designed to lift heavy and bulky materials, such as concrete panels 12, having widths of at least 8 feet.

A pair of gripping jaws 36 and 38 are pivotally attached to the main beam, one at each end thereof by pivot pins 42 and 44, respectively.

Figure 5:
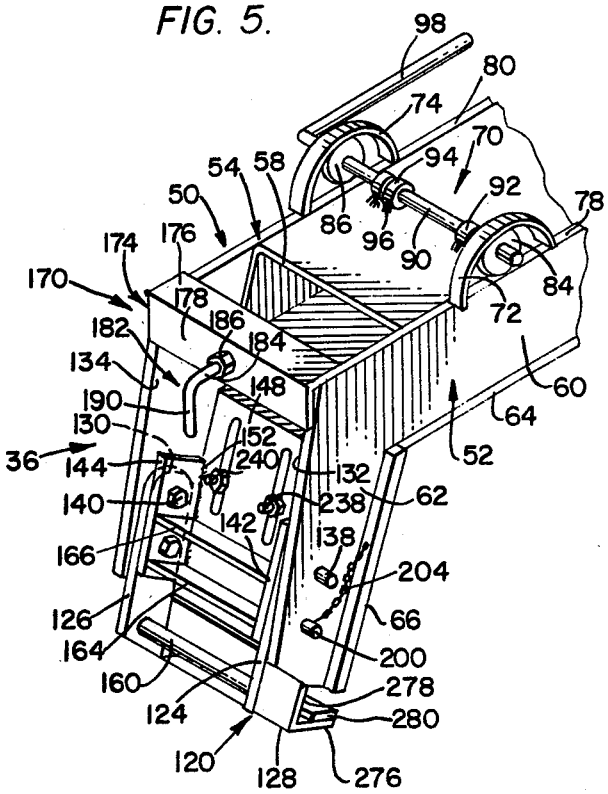
FIG. 5 is a partial perspective of the device embodying the teachings of the present invention in the working configuration.

As shown in FIG. 5, the gripping jaws each include a frame 50 comprising a pair of angle plates 52 and 54 which are positioned to be in spaced parallelism with each other and between which the main beam terminal end 58 is interjacent. The plates each have an upper section 60 and a lower section 62 integral therewith and outwardly depending therefrom to be angularly disposed with respect thereto. A pair of spanner plates 64 and 66 are attached to the plates as shown in FIG. 5 so that the beam is encased within the gripping jaw frame on three sides thereof. The gripping jaw frame therefore extends outwardly beyond the main beam terminal end 58. As shown in FIG. 1, two pairs of spacer plates 68 are interpositioned between the gripping jaw frame and the main beam.

The gripping jaws are each movably attached to the main beam by a locking mechanism 70 which includes a pair of cam guides 72 and 74 each being semi-circular in shape and each attached to upper marginal edges 78 an 80 of the top plate 60 of the frame member 50. A pair of circular cams 84 and 86 are movably received in the cam guides 72 and 74, respectively, and are eccentrically mounted on a journal shaft 90 near the outer ends of that shaft. A pair of journal bearings 92 and 94 are surmounted on the main beam, as by weldments 96, or the like. A handle 98 is attached to one end of the journal shaft to extend to right angles thereto. The mechanism 70 can also be a positioning mechanism for positioning the gripping jaw with respect to the main beam according to the angular position of the handle with respect to the main beam, as will be discussed below.

Figure 3:
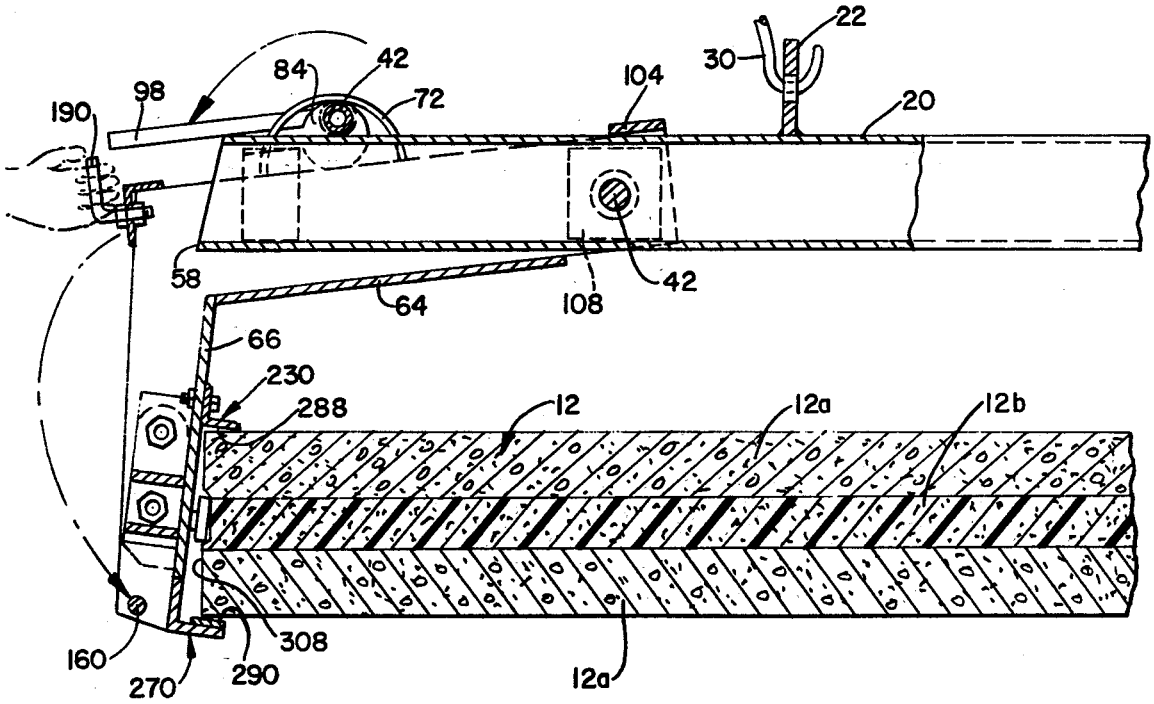
FIG. 3 is a patial elevation view of the device embodying the teachings of the present invention in the working configuration.
Figure 4:
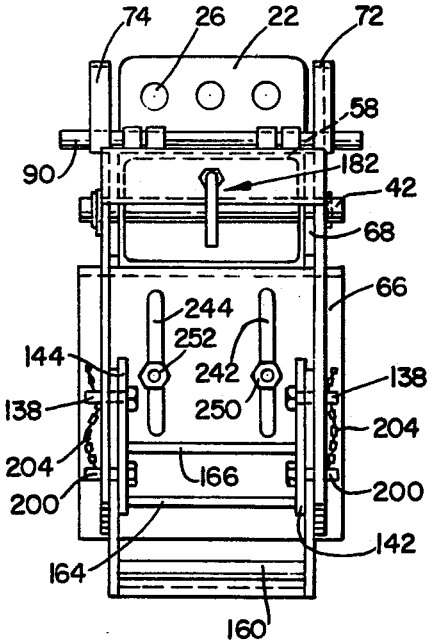
FIG. 4 is an end view of the device embodying the teachings of the present invention in the working configuration.

The eccentric mounting of the cams 84 and 86 on the journal shaft 90 is best shown in FIGS. 2 and 3. As the handle 98 is rotated from the FIG. 2 position to the FIG. 3 position, the cams rotate, but as the shaft is offset from the center of the cams, that shaft follows an epicyclic path. The cam is constrained by the semi-circular cam guide, and thus forces the gripping jaw downwardly from the FIG. 2 position into the angular offset FIG. 3 position. A limit stop 104 is attached to the frame top plates 60 and spans the main beam to abut the main beam when the gripping jaw has undergone a suitable angular displacement. A pair of slip plates, such as plate 108, are interposed between the sides of the main beam and the plates 60 to facilitate the pivotal movement of the gripping jaws.

Panel supporting brackets 120 are pivotally intermounted between the depending legs 62 of the frame member 50. The brackets 120 each includes a pair of elongate side plates 124 and 126 each having a lower terminal end 128 and an upper terminal end 130, and each pivotally attached to the inner opposed faces 132 and 134 of the legs 62 by pivot pins 138 and 140, respectively. A pair of rectangular backing plates 142 and 144 are attached to surface 148 of spanner plate 66, as by weldments 152, or the like, and the side plates are interjacent the backing plates and the legs 62. As shown in FIG. 5, the pivot pins 138 and 140 fit through the legs 62, the plates 124 and 126, and the backing plates 142 and 144 to pivotally attach the supporting brackets 120 to the frame 50 of the gripping jaw. The pivot pins fit through the plates 124 and 126 near the upper terminal ends thereof so that the brackets 120 are pendently supported from the gripping jaw frame by the pivot pins.

The side plates 124 and 126 are interjoined by a locking bar 160 which is positioned near the lower ends 128 of the plates. A pair of slat-like cross members 164 and 166 interconnect the two backing plates 142 and 144 together. The brackets 120 pivot from a repose position shown in FIG. 2 to a working, or supporting, position shown in FIG. 3. Quick-latches 170 lock the brackets 120 in the FIG. 2 repose position in a location which prevents the brackets from contacting a panel to be lifted. Each quick-latch comprises an end cap 174 which includes a top plate 176 and a front plate 178, which plates are integrally joined to form an angle corresponding to the angular joint formed by plates 60 and 62 of the frame 50, and which are mounted thereon. A locking handle 182 has a pair of sections integrally jointed to form a right angle, with a horizontal leg 184 rotatably attached to front plate 178 of the end cap by a connecting nut 186, and a vertical leg 190 spaced from the front plate 128 by the horizontal leg a distance sufficient to permit the locking bar 160 to be interpositioned therebetween when the gripping jaw is to be locked in the FIG. 2 repose position.

The brackets 120 are retained in the repose position by engagement of the vertical leg 190 of the locking handle 182, and the locking bar 160, as shown in FIG. 2. The bracket is released by rotating the vertical leg 190 either clockwise or counterclockwise to remove that leg from engagement with the locking bar 160. The thus released bracket swings downwardly in dropleaf fashion as shown by the arrow in FIG. 3 into the supporting position.

The legs 62 and backing plates 142 and 144 have aligned holes, such as hole 194 shown in FIG. 2, defined therein. The side plates 124 also have holes, such as hole 196 shown in FIG. 2, defined therein. When the brackets 120 are in the FIG. 3 supporting position, the holes 196 are aligned with and interposed between aligned holes in the legs 62 and backing plates. Removable locking pins, such as pin 200 shown in FIG. 5, are fit through the aligned holes to lock the brackets 120 into the FIG. 3 supporting position. The locking pins are attached to the gripping jaws by a tethering chain 204 to prevent loss of the pins when the brackets are in the repose position. The chain 204 is shown in FIG. 5 to be anchored to spanner plate 66, but can be anchored to any other suitable gripping jaw element.

As shown in FIGS. 2–5, a hold-down detent 230 comprises a bracket 232 which includes a vertical leg 234 and a horizontal leg 236 integrally connected together to form a right angle. The detent is shiftably connected to each spanner plate 66 by a pair of mounting bolts 238 and 240 which extend through detent mounting slots 242 and 244 defined in the plate 66 and holes defined in the detent vertical leg 234 to be aligned with the slots 242 and 244, respectively. Lug nuts 250 and 252 are threadably attached to the mounting bolts to attach the detent to the plate 66 in the desired position. The function of the hold-down detent will be described below.

The hold-down detent can be moved upwardly to a location subjacent the lower surface 254 of the spanner plate 64 as shown in FIG. 2 to accommodate thick panels.

An angle bracket 270 having a vertical leg 272 attached to and spanning the supporting bracket side plates at the front edges 274 thereof and a horizontal leg 276 extending outwardly from the front edges 274 is located immediately adjacent lower terminal end 128 of each of the side plates.

A wear strip 280 is affixed to top surface 284 of each angle bracket horizontal leg 276, and that strip, along with the horizontal leg 276, are in spaced parallelism with the hold-down detent horizontal leg 236 when the supporting bracket is in the FIG. 3 supporting position. The hold-down detent is positioned on the plate 66 so that the spacing between the detent horizontal leg bottom surface 288 and wear strip top surface 290 will accommodate the panel 12 as shown in FIG. 3.

Each gripping jaw includes a projecting ram 300 which is attached to spanner plate front surface 302 near bottom terminal end 304 thereof so that the ram 300 is located between the bracket 270 and the hold-down detent 230 when the supporting bracket is in the FIG. 3 supporting configuration. The ram is located on the spanner plate to engage a groove 306 defined in side edge 308 of the panel 12 to be co-extensive with that panel. The ram is elongate and serves to maintain the panel properly positioned in the gripping jaws.

As shown in FIG. 3, in the supporting position, the gripping jaw is skewed with respect to the panel side edge 308, and the gripping jaws can be attached to the main beam, or the angular disposition between the frame legs 60 and 62 can be adjusted by positioning the pivot pin 42 and/or adjusting the angular disposition of the legs 62 with respect to the panel side edge 308 according to the angular position of the handle 98 with respect to the main beam to provide any amount of skew desirable. Thus, by moving the various pivot points or locating the handle 98, or by adjusting the gap between elements 230 and 270, the holder 10 can be properly and quickly adjusted to execute a lifting operation for the most expeditious lifting technique. The wide spacing between the pivot points 42, 44 of the gripping jaws (as opposed to the prior art spacing) properly orients the forces applied to the gripping jaws to the panel 14 so that force will not crush or otherwise damage that panel during the lifting operation thereof. Thus, not only is the device embodying the teachings of the present invention amenable to adjustment for expeditious lifting techniques, the device also exerts lifting forces on the panel which forces are not likely to crush or otherwise damage that panel.

The operation of the holder 10 is apparent from the above description thereof, and accordingly, will be presented only in broad terms. The lifting clamps are used without the supporting brackets to initially lift the panels off the continuous steel pallet on which they were extruded and then saw cut to length. The panel 12 is then positioned on pallet 14 and the holder 10 is positioned thereabove, as shown in FIGS. 1 and 2. Once the initial lift is made, the clamps can be reseated on the panel and the supporting brackets positioned under the panel both for safety reasons and to help share the load (which increases as the panels are transported). Suitable lifting clamps are shown in the booklet entitled "Butler Corewall Modular Panels," Form No. 3834-7-76 by Butler Manufacturing Company of Kansas City, Mo. The transportation mode, i.e., after the initial lift has been made and access gained for positioning the supporting brackets, is performed in the following manner. The gripping jaws are moved from the FIG. 2 repose position into the FIG. 3 working position by manipulating the handle of mechanism 70, and the supporting brackets 120 are released by movement of the quick-latch. Supporting brackets are positioned in the working position as shown in FIG. 3, and the locking pins 200 are inserted into the aligned holes in each of the gripping jaws. The associated hoisting devices are actuated, and the panel is lifted and moved as desired. The above-described procedure is reversed to remove the holder from the panel.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A lifting device for lifting large panels comprising:

a main beam;

a pair of gripping jaws each connected at one end of said main beam and each including a gripping jaw frame pivotally connected to said main beam, said gripping jaws each being adapted to assume a repose position spaced from a panel to be lifted and a working position adjacent such panel;

positioning means for positioning each gripping jaw frame with respect to said main beam to establish a desired angular relationship between said each gripping jaw frame and said main beam, said positioning means including guide means on said each gripping jaw frame, gripping jaw frame moving means engaged with said guide means, and a manually operable means pivotally connected to said main beam and eccentrically connected to said frame moving means to eccentrically move said frame moving means with respect to said guide means upon operation of said manually operable means whereby said each gripping jaw is moved between said repose and working positions; and supporting means pivotally mounted on said frame for supporting a panel.

2. The lifting device of claim 1, wherein said supporting means is adapted to assume a repose position and a working position, wherein said supporting means contacts a panel, and wherein said gripping jaws each further include a locking means connected to said frame to lock said supporting means in said repose position, said locking means including a handle rotatably mounted on said frame and a locking bar mounted on said supporting means in a position to contact said locking handle when said supporting means is in said repose position.

3. The lifting device of claim 1, wherein said gripping jaws each are adapted to assume a repose position spaced from a panel to be lifted and a working position adjacent such panel, and wherein said guide means includes a pair of spaced cam guides each being semicircular in shape and each connected to said gripping jaw frame, said frame moving means including a pair of cams, each cam being received in one of said cam guides to rotate therein, said manually operable means including a journal shaft connected to each end to one of said cams for rotation therewith, a pair of journal bearings mounted on said main beam to be connected to said gripping jaw frame via said positioning means, and a handle connected at one end to one end of said journal shaft for rotation therewith, said journal shaft being connected to said cams at a location thereon spaced apart from the center of said cams to produce eccentric movement of said cams when said handle is rotated so that said cams move eccentrically in said semi-circular cam guides to move said gripping jaws with respect to said main beam.

4. The lifting device of claim 3, wherein said journal shaft is connected to said cams near the outer perimeter thereof, so that said shaft undergoes an epicyclic movement during rotation thereof.

5. The lifting device of claim 1, further including a pair of spacer plates mounted on each of said gripping jaw frames.

6. The lifting device of claim 5, wherein each gripping jaw further includes a hold-down detent mounted on one of said spacer plates to engage the top of a panel being lifted.

7. The lifting device of claim 6, wherein each gripping jaw further includes adjusting means on said one spacer plate for adjusting the position of said hold-down detent.

8. The lifting device of claim 5, wherein each gripping jaw further includes an angle bracket connected to said supporting means for contacting a panel to be lifted.

9. The lifting device of claim 5, wherein each gripping jaw further includes an elongate ram mounted on said one spacer plate to engage a groove defined in one edge of a panel being lifted.

10. The lifting device of claim 5, wherein each gripping jaw further includes a locking pin attached to said gripping jaw and removably inserted through aligned holes defined in said gripping jaw frame and said supporting means to lock said supporting means in a supporting position.

* * * * *